US005342215A

United States Patent [19]

Silbernagel et al.

[11] Patent Number: 5,342,215

[45] Date of Patent: Aug. 30, 1994

[54] RELEASABLE LATCHING SYSTEM FOR ELECTRICAL CONNECTORS

[75] Inventors: Raymond A. Silbernagel, Naperville; Edward S. Sommer, Addison, both of Ill.

[73] Assignee: Molex Incorporated, Lisle, Ill.

[21] Appl. No.: 80,262

[22] Filed: Jun. 21, 1993

[51] Int. Cl.[5] ..... H01R 13/627

[52] U.S. Cl. ..... 439/357; 439/527

[58] Field of Search ..... 439/133, 304, 345, 350, 439/353, 354, 357, 358, 527, 533, 575

[56] References Cited

U.S. PATENT DOCUMENTS

| | | | |
|---|---|---|---|
| 4,451,100 | 5/1984 | Jaconette . | |
| 4,615,575 | 10/1986 | Kossor | 439/304 |
| 4,647,128 | 3/1987 | Maros . | |
| 4,681,387 | 7/1987 | Paddock | 439/347 |
| 4,867,699 | 9/1989 | Oda et al. | 439/350 X |
| 4,900,261 | 2/1990 | Gentry et al. | 439/353 |
| 4,915,336 | 4/1990 | Handy | 439/304 X |
| 4,915,648 | 4/1990 | Takase et al. | 439/490 |
| 5,201,669 | 4/1993 | Lin | 439/357 |
| 5,210,934 | 5/1993 | Lenzi et al. | 29/764 |
| 5,217,384 | 6/1993 | Merten et al. | 439/304 |

FOREIGN PATENT DOCUMENTS

| | | |
|---|---|---|
| 0323567 | 11/1988 | European Pat. Off. . |
| 0437765 | 12/1990 | European Pat. Off. . |

*Primary Examiner*—Khiem Nguyen

*Attorney, Agent, or Firm*—Stephen Z. Weiss

[57] ABSTRACT

A releasably latching system is provided for an electrical connector assembly which includes first and second connectors. The first connector has a front mating face and a rear face. The second connector has a front mating face for interfacing with the front mating face of the first connector. A latch arm extends forwardly from the rear face of the first connector and includes a forward latch hook for latching engagement with a latch shoulder associated with the second connector. An aperture is provided in the rear face of the first connector and into which a tool can be inserted in engagement with the latch arm to move the forward latch hook out of latching engagement with the latch shoulder associated with the second connector.

11 Claims, 3 Drawing Sheets

RELEASABLE LATCHING SYSTEM FOR ELECTRICAL CONNECTORS

FIELD OF THE INVENTION

This invention generally relates to the art of electrical connectors and, particularly, to a releasable latching system for an electrical connector assembly.

BACKGROUND OF THE INVENTION

Electrical connectors often are used in mating pairs or assemblies which include a male or plug connector mateable with a female or receptacle connector. Of course, a single connector often is used with a mating electrical device which may be part of a chassis, for instance. Electrical terminals are mounted within the connectors or mating devices for interconnection in mated condition. In some applications, the frictional engagement between the male and female connectors are relied upon for maintaining a secured relation of the connectors in their mated condition.

However, frictional engagements between mating connectors usually are unsatisfactory when the connectors are used in various environments or applications where shock, vibration or acceleration can cause the connectors to separate, such as in appliances having vibrating motors or other components. Therefore, connectors have been designed for such applications to include various latching systems. In order to unmate the connectors, the latching systems most often are designed in one form or another so that they are releasable.

One common type of releasable latching system incorporates one or more levers or latch arms which project from one connector into latching engagement with a second connector or connecting device. The connectors, themselves, most often include a dielectric housing, such as a unitarily molded plastic housing, and the levers or latch arms usually are molded as integral, flexible components projecting from the housing and snap-latchingly engageable with latch bosses or other portions on the mating connector. A typical releasable latching system has a latch arm located on an outside wall of one connector, with a hooked latch portion on a rearward distal end of the latch arm for engaging a latch boss or shoulder on the mating connector. By providing the latch arms alongside an outside wall of the connector, a compact package is provided, and the latch arm is releasable simply by pulling the arm outwardly of the connector housing to release its interengagement with the latch boss of the mating connector.

Problems are encountered with releasable latching systems as described above, particularly the latch arm type systems, when the connectors are used in crowded environments. Often, there simply is insufficient room to gain access to the latch arms from the outside of the connectors in order to release the latching interengagement of the arms. For instance, the connectors may be used within chassis wherein panels or walls of the chassis bound the connectors and an operator's fingers or a tool cannot be manipulated to release the latching arms. Or, a plurality of connectors may be used on a panel in a close side-by-side array, and, again, insufficient room is provided between the connectors to gain access to the latch arms for releasing the same.

This invention is directed to solving the problems described above and satisfying the need for a simple, inexpensive means for affording access to a releasable latching system of the character described.

SUMMARY OF THE INVENTION

An object, therefore, of the invention is to provide a new and improved releasable latching system for an electrical connector assembly.

The connector assembly may include a first connector having a front mating face and a rear face, along with a second connector having a front mating face for interfacing with the front mating face of the first connector. A latch arm extends forwardly from the rear face of the first connector and includes a forward latch portion thereon for latchingly engaging a complementary latch means associated with the second connector.

The invention contemplates the provision of an aperture in the rear face of the first connector and into which a tool can be inserted into engagement with the latch arm to move the forward latch portion out of engagement with the latch means associated with the second connector. The aperture is completely within the confines of the rear face of the first connector, and the connector, itself, does not in any way have to be enlarged in order to afford access to the latch arm to release its latching engagement with the complementary latch means associated with the second connector.

As disclosed herein, the latch arm is located generally on the outside of the first connector. The latch portion is provided by an inwardly directed latch hook at a front distal end of the latch arm. The complementary latch means is provided by a latch shoulder associated with the second connector behind which the latch hook is snappingly engageable. A tool-engaging cam portion is located on the latch arm rearwardly of the latch hook and is directed inwardly near the aperture in the rear face of the first connector. Preferably, the connector includes a molded dielectric housing having the latch arm molded integrally therewith. The latch arm is cantilevered about an integral hinge portion near the rear face of the first connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
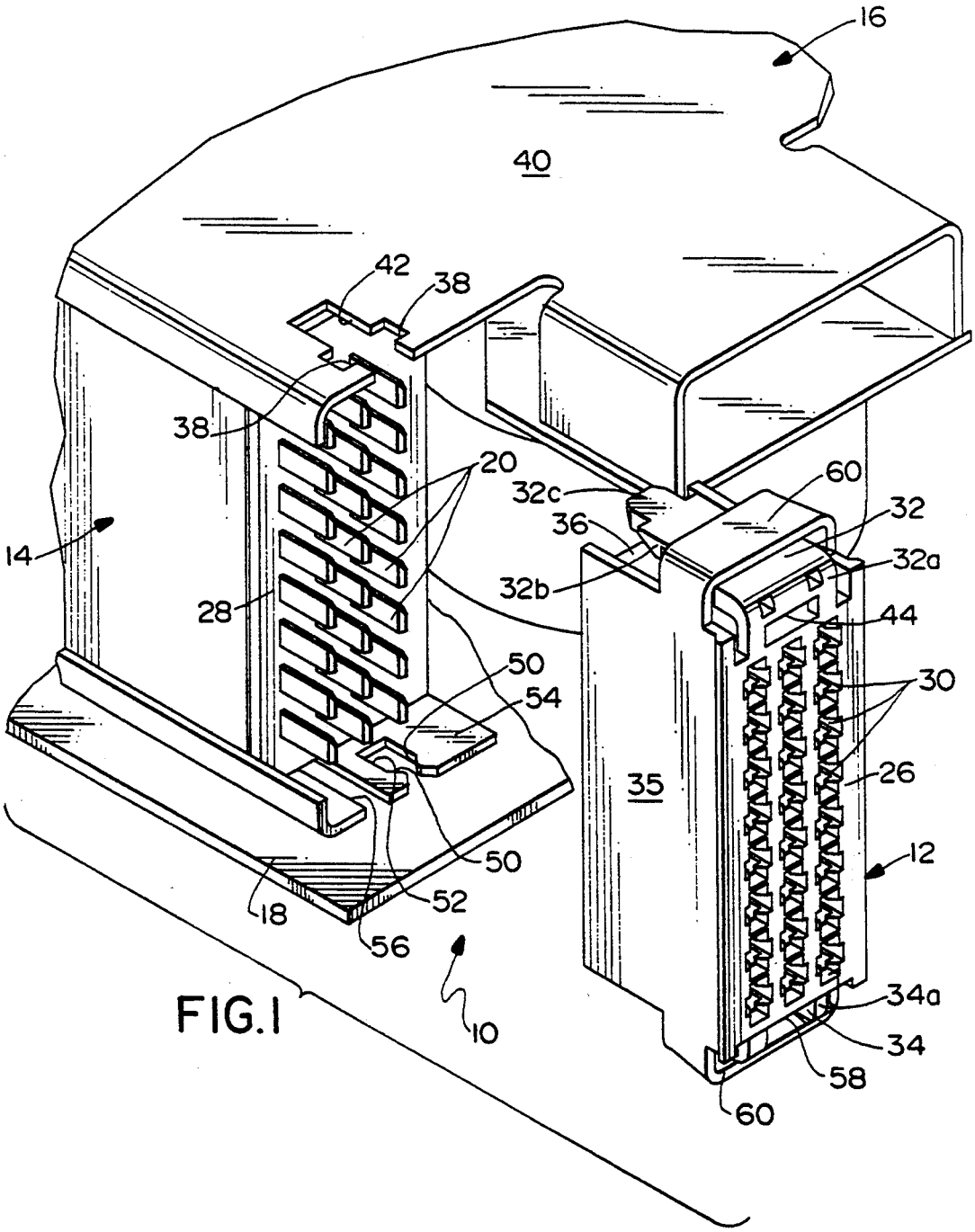
FIG. 1 is a perspective view of an electrical connector assembly in conjunction with a mounting chassis and embodying the releasable latching system of the invention.
Figure 2:
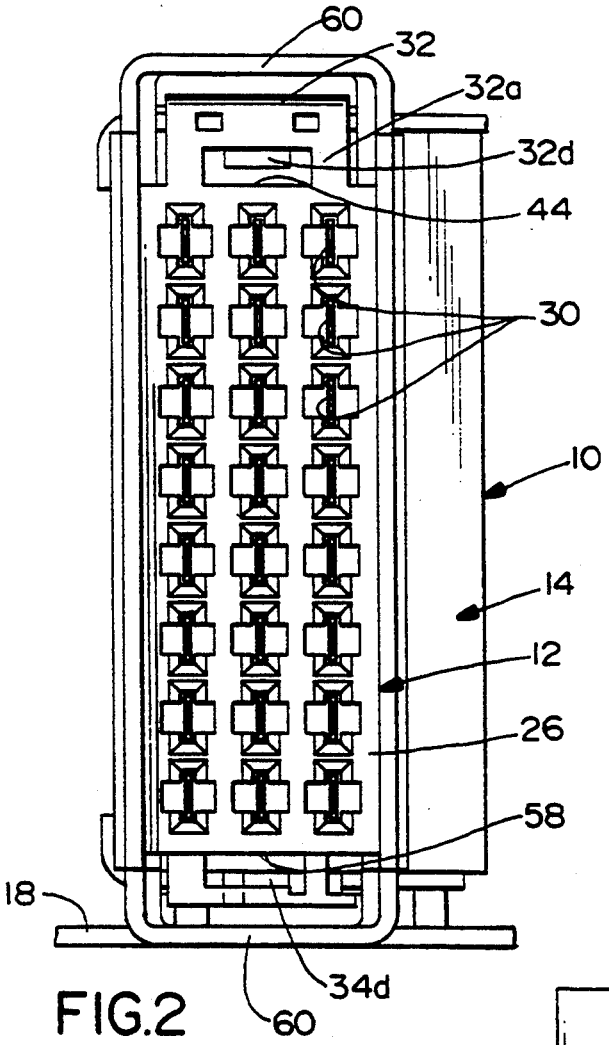
FIG. 2 is a rear elevational view of the connector assembly.

Referring to the drawings in greater detail, and first to FIG. 1, the invention is embodied in an electrical connector assembly, generally designated 10, which includes a first connector, generally designated 12, mateable with a second connector, generally designated 14. The second connector is mounted within a chassis, generally designated 16, which includes a base wall 18 above which the second connector 14 is mounted. This connector assembly and mounting arrangement is for illustration purposes, because the latching system of the invention has a wide range of applications for a wide variety of connector assembly designs. For instance, it will be seen, below, that the latching system of the invention is operatively associated between first connector 12 and portions of chassis 16 adjacent second connector 14. The latching system may be used directly between a pair of mating connectors, or between a single connector and a variety of mating devices, panels or the like.

Figure 4:
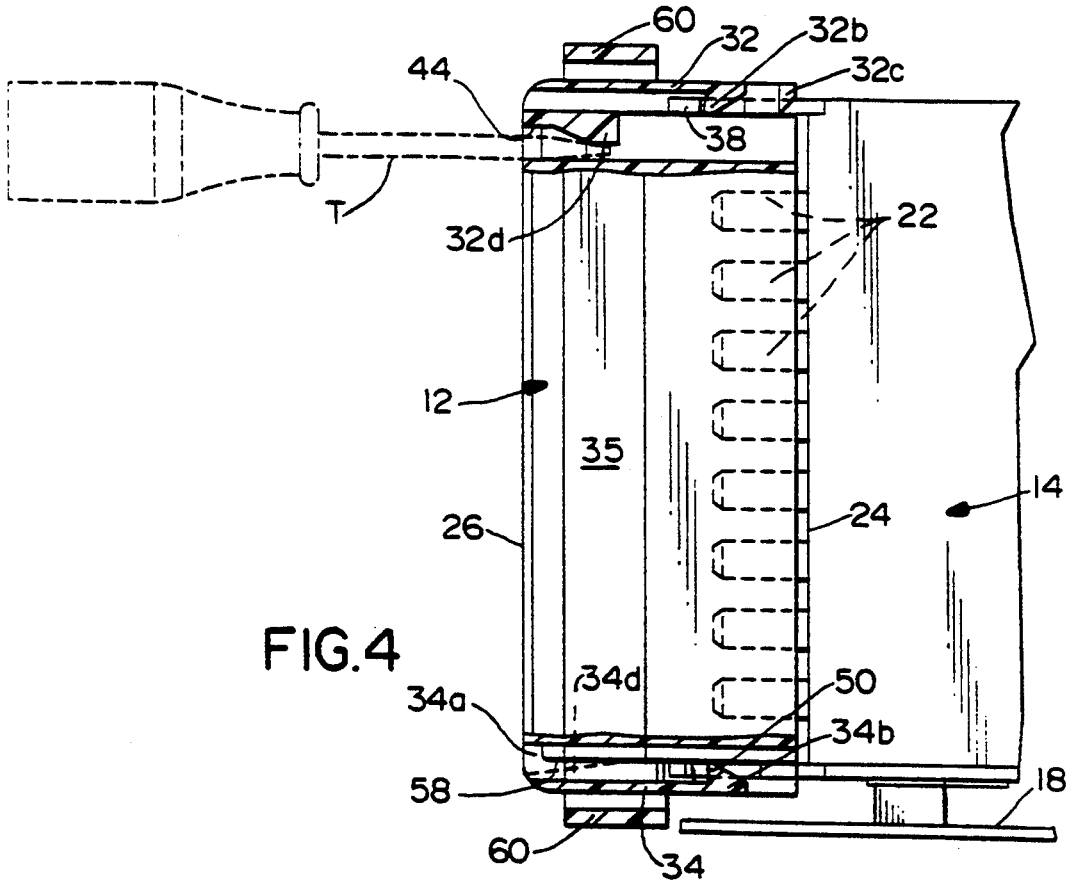
FIG. 4 is a vertical section through the connector assembly, and showing a tool (in phantom) about to release one of the latch arms.
Figure 5:
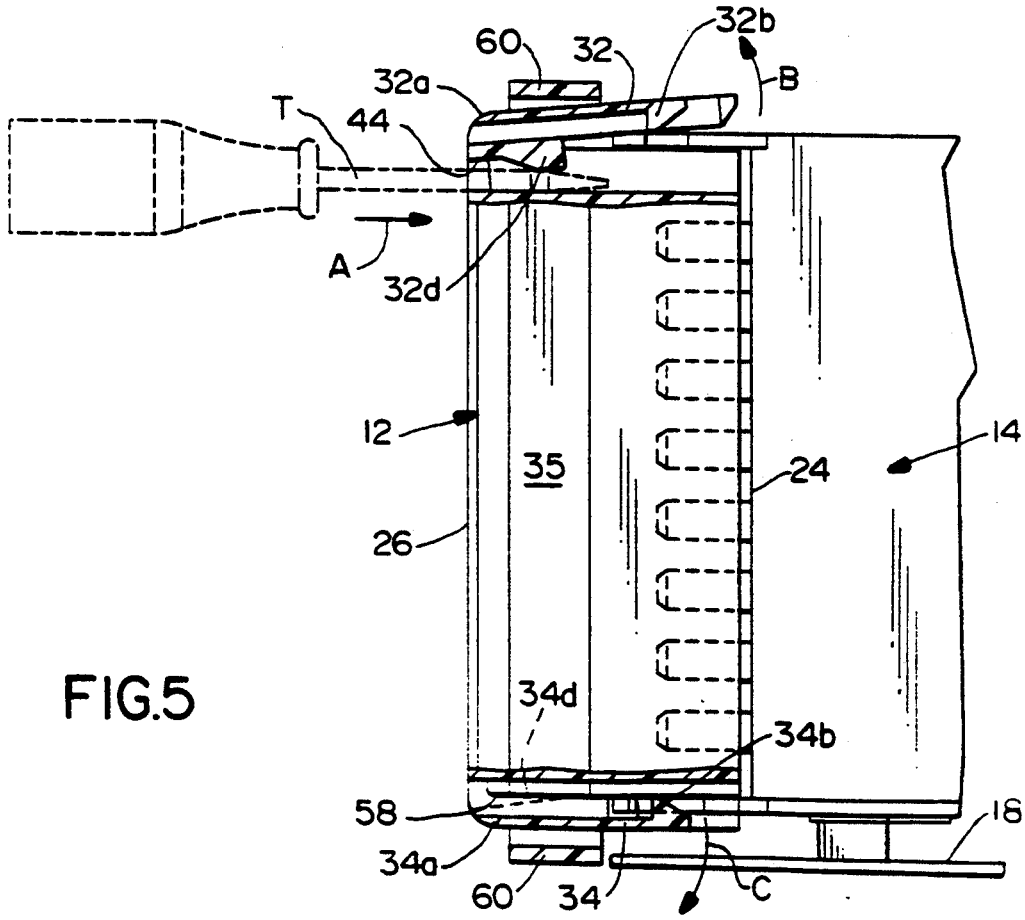
FIG. 5 is a view similar to that of FIG. 4, with the tool inserted further into the aperture for releasing the latch arm.

In actual practice, second connector 14 is a timer block within a chassis of a large appliance. First connector 12 is a timer receptacle. The second connector has a plurality of terminal blades 20 which are insertable into terminal receptacles 22 (FIGS. 4 and 5). The first connector has a front mating face 24 and a rear face 26. The second connector has a front mating face 28 for interfacing with front mating face 24 of the first connector. The first connector has a plurality of holes 30 in its rear face which communicate with receptacles 22 and from which electrical wires project from rear face 26, the electrical wires being terminated to receptacles 22. Therefore, upon mating of first connector 12 and second connector 14, the electrical wires which are terminated in the first connector are interconnected with terminal blades 20 of the second connector.

The releasable latching system of the invention includes a first latch arm 32 at the top end of the connector 12, as viewed in the drawings, and a second latch arm 34 at the opposite or bottom end of the connector. Latch arm 32 first will be described, immediately below.

More particularly, first connector 12 includes a molded dielectric housing 35 which defines front and rear faces 24 and 26, respectively, and latch arm 32 is integrally molded therewith about an integral hinge portion 32*a* near rear face 26, as best seen in FIG. 1. The latch arm is cantilevered about the integral hinge portion so that it extends forwardly on the outside of a wall 36 of the connector housing. A forward latch portion, in the form of an inwardly directed latch hook 32*b*, is provided for latching engagement with a latch shoulder 38 formed in a top wall 40 of chassis 16. Actually, a pair of latch shoulders 38 can be seen in FIG. 1 to be formed on opposite sides of a slot 42 formed in wall 40 of the chassis. The slot forms a guideway for a narrow distal end or tip 32*c* of latch arm 32.

The invention contemplates the provision of an aperture 44 in rear face 26 of first connector 12 and into which a tool "T" (FIGS. 4 and 5) can be inserted into engagement with latch arm 32 to move latch hook 32*b* out of engagement with latch shoulders 38 which are associated with second connector 28. Specifically, referring to FIGS. 4 and 5, latch arm 32 includes an inwardly directed, tool-engaging cam portion 32*d* which is in a path of insertion of tool "T" when the tool is inserted into aperture 44.

In operation, it can be seen in FIG. 4 that tool "T" (such as a conventional screw driver) is shown to be inserted slightly into aperture 44 at rear face 26 of the first connector. It can be seen that hook portion 32*b* of latch arm 32 is in latching engagement with latch shoulders 38 operatively associated with second connector 14. Reference then is made to FIG. 5, wherein it can be seen that the tool has been inserted further into aperture 44, in the direction of arrow "A", and the tip of the tool has engaged cam portion 32*d* and has pivoted latch arm 32 outwardly in the direction of arrow "B" about its hinge portion 32*a*. The first connector, or at least the top portion thereof, now can be unlatched from the second connector from the rear of the first connector. In other words, access does not have to be provided from the side or end of the connector. Such access may not be available in compact environments or applications as described in the "Background", above.

Figure 6:
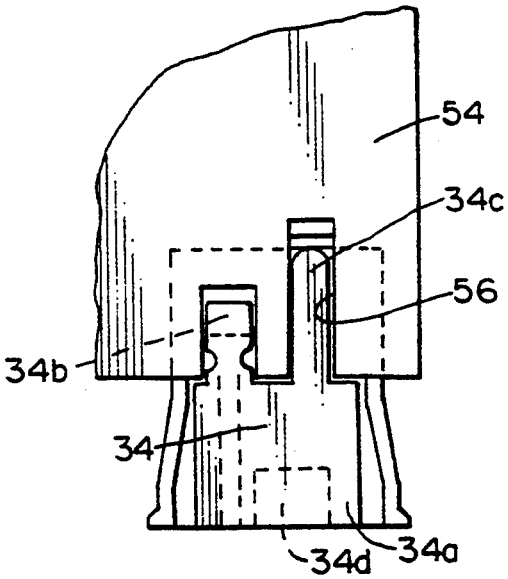
FIG. 6 is a bottom plan view of the connector assembly, with a fragmentation through the chassis.
Figure 3:
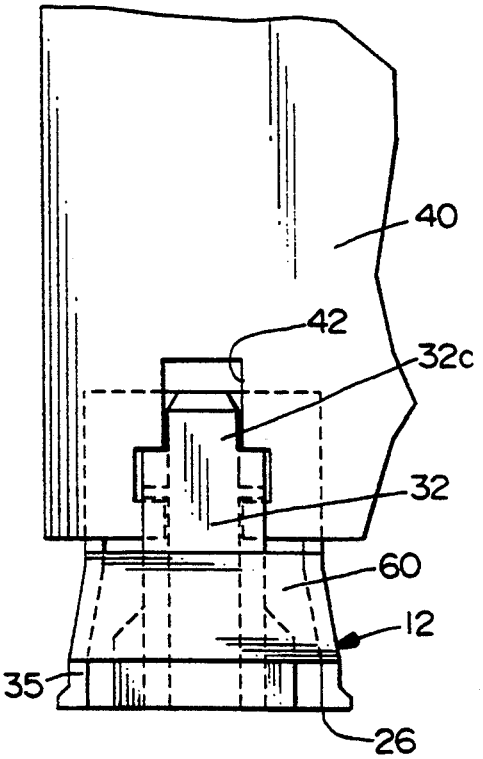
FIG. 3 is a top plan view of the connector assembly, with a fragmentation through the chassis.

The second or bottom latch arm 34 functions substantially identical to latch arm 32, as described above. More particularly, like latch arm 32, latch arm 34 is integrally joined to connector housing 35 by a living hinge 34*a* at the rear end of the latch arm, and a latch portion in the form of a latch hook 34*b* is inwardly directed at the forward end of the latch arm. The hook portion is best seen in FIGS. 4 and 5, and the hook portion latchingly engages behind a pair of latch shoulders 50 which are best seen in FIG. 1. The latch shoulders are on opposite sides of a slot 52 cut into a lower wall 54 of chassis 16. Whereas upper latch arm 32 has a narrow distal end 32*c* for guiding into slot 42 of upper chassis wall 40, lower latch arm 34 has a forwardly extending tongue 34*c*which is shown in FIG. 6 to extend into a slot 56 in lower chassis wall 54 to provide a guideway for the tongue.

Like latch arm 32, latch arm 34 has an inwardly directed, tool-engaging cam portion 34*d* for engagement by a tool to pivot the latch arm outwardly in the direction of arrow "C" (FIG. 5) to disengage latch hook 34*b* from latch shoulder(s) 50. According to the invention, an aperture 58 is provided in rear wall 26 for the insertion thereinto of a tool into engagement with cam portion 58 to pivot latch arm 34 out of its latching engagement, whereupon the two connectors can be completely unmated.

Lastly, a pair of band-like bridge portions 60 span the ends of first connector 12 outside latch arms 32 and 34. These bridge portions are molded integrally with the connector housing and provide an anti-overstress means to prevent the latch arms from being bent too far outwardly of the connector housing, which might overstress the latch arms. This can be seen best in FIG. 5 where the upper bridge portion 60 is shown just slightly spaced from latch arm 32 which is in its unlatched condition. After only slight additional pivotal movement of the latch arm, it will engage bridge portion 60 to prevent any further pivotal movement of the latch arm substantially beyond its unlatched condition.

From the foregoing, it can be seen that latch arms 32 and 34 are releasable by a tool "T" inserted into apertures 44 and 58, respectively, completely within the bounds of the connector and from a rear end thereof. Access does not have to be provided to the sides or ends of the connector in order to release the latch arms. For instance, as seen best in FIGS. 4 and 5, base wall 18 of chassis 16 would prevent any access whatsoever to the lower latch arm 34. This also might be true of the other latch arm in a given connection environment. Chassis 16, including upper and lower walls 40 and 54, respectively, along with base wall 18, is but an illustration of one connection environment for connector 12 and its novel releasable latching system. All kinds of applications can be imagined wherein the connector might be used in close quarters where an operator could not gain access to the sides or ends of the connector in order to release the latch arms thereat.

Lastly, it should be understood that, while latch shoulders 38 and 50 are formed in upper and lower chassis walls 40 and 54, respectively, in order to be operatively associated with second connector 14, the latch shoulders for engagement by the latch hook portions of latch arms 32 and 34 could be associated directly with connector 14 and be provided directly on the connector housing thereof. In fact, this a common expedient in latchable electrical connectors wherein latch bosses or shoulders are provided integrally molded with the connector housing, rather than being on separate chassis walls as disclosed herein. Again, the second connector and the chassis disclosed herein are but for illustration purposes to show a sort of compact environment, such as in a timer block arrangement of a large appliance.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A releasable latching system for an electrical connector assembly which includes a first connector having a front mating face and rear face, a second connector having a front mating face for interfacing with the front mating face of the first connector, a latch arm extending forwardly from the rear face of the first connector and including a forward latch portion thereon for latching engagement with a complementary latch means associated with the second connector, wherein the improvement comprises an aperture in the rear face of the first connector through the latch arm and into which a tool can be inserted in engagement with the latch arm to move the forward latch portion out of latching engagement with the latch means associated with the second connector.

2. A releasable latching system as set forth in claim 1 wherein said latch arm is located generally on the outside of the first connector and the latch portion thereon comprises an inwardly directed latch hook, and said complementary latch means comprises a latch shoulder behind which the latch hook is engageable.

3. A releasable latching system as set forth in claim 2 wherein said latch arm includes a tool-engaging cam portion located rearwardly of the latch hook.

4. A releasable latching system as set forth in claim 3 wherein said cam portion is directed inwardly and is located near the aperture in the rear face of the first connector.

5. A releasable latching system as set forth in claim 4 wherein said first connector includes a molded dielectric housing having the latch arm molded integrally therewith.

6. A releasable latching system as set forth in claim 5 wherein said latch arm is cantilevered about an integral hinge portion near the rear face of the first connector.

7. A releasable latching system for an electrical connector which includes a dielectric housing having a rear face and an outer side wall extending forwardly of the rear face, and a latch arm extending forwardly along the side wall and including a forward latch means for latching engagement with a complementary electrical device, wherein the improvement comprises an aperture in the rear face of the connector through the latch arm and into which a tool can be inserted in engagement with the latch arm to move the forward latch means out of engagement with the complementary electrical device.

8. The releasable latching system of claim 7 wherein said latch arm includes a tool-engaging cam portion located rearwardly of said forward latch means.

9. The releasable latching system of claim 8 wherein said cam portion is directed inwardly and is located near the aperture in the rear face of the connector.

10. The releasable latching system of claim 7 wherein said latch arm is molded integrally with the housing for pivotal movement about an integral hinge portion near the rear face of the connector.

11. A releasable latching system for an electrical connector which includes a dielectric housing having a forward mating face and an outer side wall, and a latch arm extending forwardly along the side wall and including a forward latch means for latching engagement with a complementary electrical device, wherein the improvement comprises aperture means in the housing remote from the forward mating face thereof through the latch arm and into which a tool can be inserted in engagement with the latch arm to move the forward latch means out of latching engagement with the complementary electrical device.

* * * * *